United States Patent [19]

Whittaker et al.

[11] Patent Number: 4,726,351

[45] Date of Patent: Feb. 23, 1988

[54] GAS-FIRED APPLIANCES WITH "COAL EFFECT"

[75] Inventors: David Whittaker, Trawden; Ian Clegg, Accrington, both of England

[73] Assignee: Baxi Partnership Limited, England

[21] Appl. No.: 86,224

[22] Filed: Aug. 13, 1987

Related U.S. Application Data

[63] Continuation of Ser. No. 940,239, Dec. 9, 1986, abandoned, which is a continuation of Ser. No. 681,299, Dec. 13, 1984, abandoned.

[30] Foreign Application Priority Data

Dec. 15, 1983 [GB] United Kingdom ..... 8333399

[51] Int. Cl.[4] ..... F24C 3/00

[52] U.S. Cl. ..... 126/127; 431/125; 219/344

[58] Field of Search ..... 126/127, 128, 121; 219/344; 431/125, 354; 40/428; 362/159, 184, 229, 234

[56] References Cited

U.S. PATENT DOCUMENTS

| | | | |
|---|---|---|---|
| 1,677,629 | 7/1928 | Gross | 219/344 X |
| 1,692,021 | 11/1928 | Auer | 219/344 |
| 2,084,566 | 6/1937 | Warfield | 431/125 X |
| 2,285,535 | 6/1942 | Schlett | 40/428 |
| 2,302,796 | 11/1942 | Oyster . | |
| 2,879,761 | 3/1959 | Foster et al. | 431/125 X |
| 3,042,109 | 7/1962 | Peterson | 431/125 X |
| 3,382,861 | 5/1968 | Peterson | 126/127 X |
| 3,623,470 | 11/1971 | Wilhoite | 126/127 |
| 3,993,430 | 11/1976 | Furker | 431/125 |
| 4,272,908 | 6/1981 | Bassetti et al. | 40/428 X |
| 4,305,372 | 12/1981 | Hahn | 431/354 |

FOREIGN PATENT DOCUMENTS

| | | |
|---|---|---|
| 1028701 | 5/1966 | United Kingdom . |
| 1153726 | 5/1969 | United Kingdom . |
| 1156314 | 6/1969 | United Kingdom . |
| 1360799 | 7/1974 | United Kingdom . |
| 1504138 | 3/1978 | United Kingdom . |
| 2072832 | 4/1980 | United Kingdom . |
| 2081885 | 2/1982 | United Kingdom . |
| 2080938 | 2/1982 | United Kingdom . |

*Primary Examiner*—Randall L. Green

*Attorney, Agent, or Firm*—Pravel, Gambrell, Hewitt, Kimball & Kreiger

[57] ABSTRACT

A gas fire with coal effect has a gas manifold or box divided into separate gas compartments with gas outlets therefrom and is formed with illumination apertures. The coal effect which is ceramic and has flame apertures therethrough is precisely positioned on the gas manifold or box by locating formation so that the gas outlets and flame apertures are correctly relatively disposed to avoid "sooting".

An electric lamp (preferably two) is disposed forwardly and downwardly of, and preferably centrally of, the gas manifold or box and the coal effect to provide an instantaneous "glow" effect when illuminated. This latter effect can be attained with or without flames being present.

10 Claims, 10 Drawing Figures

36
36A
36B
36C
36D
37
37A
37B
37C
37D
34
38
39
VI

GAS-FIRED APPLIANCES WITH "COAL EFFECT"

This is a continuation of co-pending application Ser. No. 940,239 filed on Dec. 9, 1986, abandoned, which is a continuation of co-pending application Ser. No. 681,299 filed on Dec. 13, 1984, abandoned.

This invention relates to gas-fired appliances with a simulated coal or a simulated log effect (hereinafter and in the claims for simplicity simply referred to as "coal effect").

With a known gas-fired appliance with coal effect the ceramic elements simulating coal are laid on a radiant block which is heated to a temperature to impart the necessary heat to the ceramic elements to cause the latter to produce the "glow" effect in the appliance. This usually entails the use of two burners, one of which serves mainly to heat the radiant block and consequently the ceramic elements to provide the "glow" effect while the other provides the flames. Only one of the burners is utilised to provide flame with the majority of the ignited gases being used to generate glow. These latter gases heat the radiant block and, in turn, the ceramic elements to produce the aesthetic "glow" effect which does not occur until the ceramic elements have attained the required temperature, i.e. there is a time delay between switching on the appliance and the appearance of the "glow" effect.

These known appliances also suffer from the fact it is difficult properly to locate the coal effect ceramic elements on the radiant block relative to the flames and the burner providing the flames is generally too far from these ceramic elements with the result that "sooting" occurs which causes an unsightly appearance and inefficient heating.

Also due to the fact that these known appliances employ two burners it is not possible to retain flame to the minimum setting, i.e. the flame is extinguished with the gas being supplied only to the radiant block heating burner.

It is an object of the present invention to provide a gas-fired appliance with coal effect which has instantaneous "glow" effect upon switching on of the appliance, which has a "glow" effect even when gas is not being supplied to the appliance, and which has a large mass of flames since the total gas input is used to produce flames.

According to the present invention there is provided a gas-fired appliance with coal effect and incorporating electric light means operable separately of, or with, the gas appliance to give a "glow" effect.

Preferably the electric light means is located relative to the coal effect to provide the "glow" effect when illuminated from a position downwardly of and/or at the sides of the coal effect.

Preferably the electric light means is at least one electric lamp connectible to a source of electricity supply.

Also according to the present invention there is provided a gas-fired appliance with coal effect comprising a gas manifold or box on which the coal effect is supported, the gas manifold or box having a gas supply inlet and a plurality of ignited gas outlets in the region of the coal effect, and an electric lamp disposed downwardly of and/or to the sides of the gas manifold or box which is apertured without gas egress occurring to permit "glow" effect illumination from the lamp to be seen from above.

Preferably, the electric lamp is disposed forwardly of the gas manifold or box.

Preferably, there are two electric lamps connected in parallel and disposed centrally, forwardly and downwardly of the gas manifold or box.

A reflector plate is preferably disposed under and behind the electric lamps to throw the light therefrom forwardly and upwardly.

It will be manifest that the electic lamp or lamps, preferably suitably coloured but alternatively enclosed in a coloured shade or cover, provides or provide an instantaneous "glow" effect, i.e. no waiting period. It is preferred that the electric lamps be separately controlled (i.e. switched on and off) to provide "glow" effect without the appliance being ignited, but the control on/off may be linked with the gas appliance control so that switching on of the latter switches on the electric lamp or lamps.

The electric lamp or lamps may be caused to give a flicker effect by known electronic control means, for example a flasher unit, or by known mechanical spinners.

The gas manifold or box is preferably divided into separate supply compartments. There are preferably two compartments which are preferably fore-and-aft relative to the front of the appliance although the compartments may be disposed laterally side-by-side. By this means, gas supply to both or one supply compartment at variable rates will permit operation of the appliance between full rate and off.

The gas manifold or box is preferably relatively shallow in depth with gas outlet holes, preferably varied in size, arranged around illumination apertures.

Preferably the gas holes comprise relatively large holes from which the flames are emitted with at each side thereof relatively small holes from which is emitted gas serving to control flames size and shape.

Preferably the gas manifold or box at the gas inlet to each compartment has an aeration hole for inflow air with the gas which serves to avoid "sooting".

The coal effect is preferably of ceramic material and is preferably of unitary construction with flame apertures matching the illumination apertures of the gas manifold or box.

The coal effect is preferably shaped accurately to conform with the shape of the gas box or manifold on which it sits, the ignited gas flowing from the latter appearing as flames through the coal effect apertures.

The unitary coal effect is preferably of closed hollow construction with, on its underside, cross lighting channels joining adjacent flame apertures.

The unitary coal effect may be of open bottomed configuration and, in this case, combustion product outlet holes are provided in the "lumps of coal" of the coal effect.

The coal effect may, of course, comprise two or more sections, whatever its construction.

Complementary location formations may be provided on the gas manifold or box and the coal effect to assist correct relative location of these two components to avoid "sooting". Such formations may comprise dowelling on the gas manifold or box with complementary holes or recesses in the coal effect.

The gas appliance casing, and/or hood (if provided) is apertured or slotted to allow heated air to egress to heat the room in which the gas appliance is located by convection.

The front of the appliance is preferably closed by a glass or suitable synthetic plastics door or window. It may, of course, be open fronted.

An embodiment of the present invention will now be described, by way of example, with reference to the accompanying drawings, in which.

Figure 1:
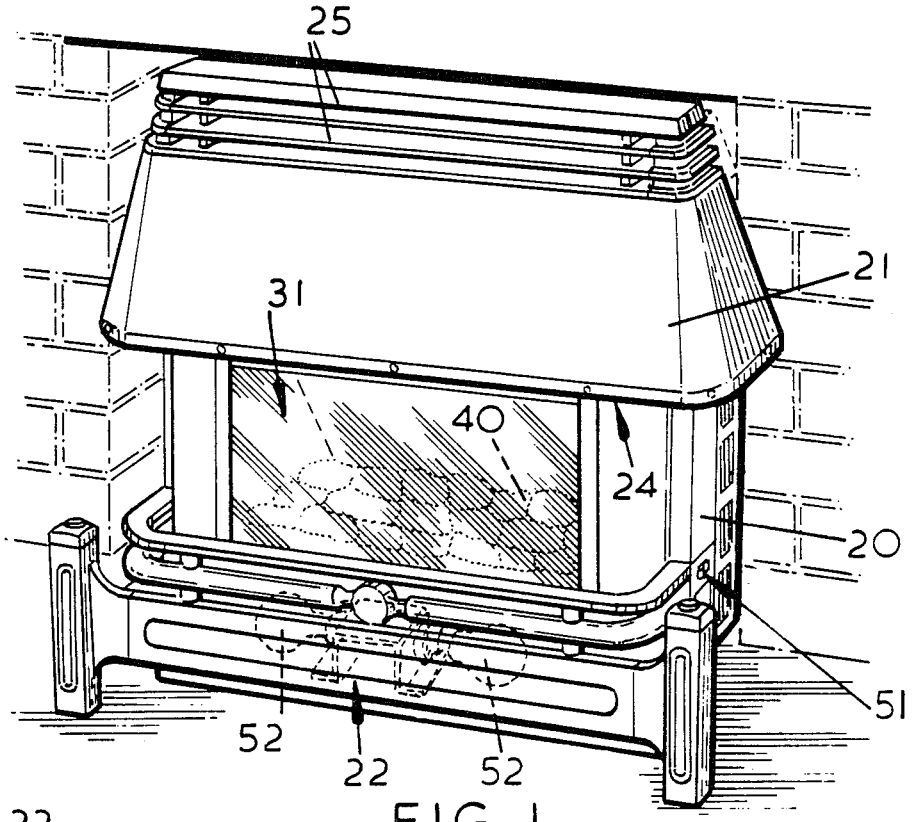
FIG. 1 is a perspective view of a gas fire with coal effect incorporating the present invention.
Figure 3:
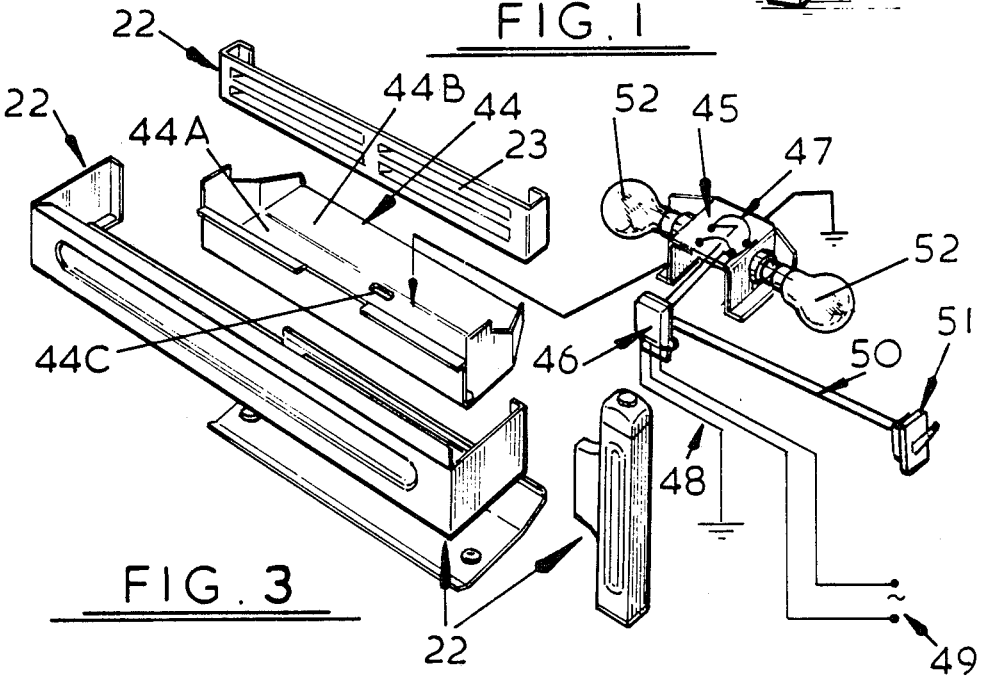
FIG. 3 is an exploded perspective view of the lower front region of the gas fire.
Figure 2:
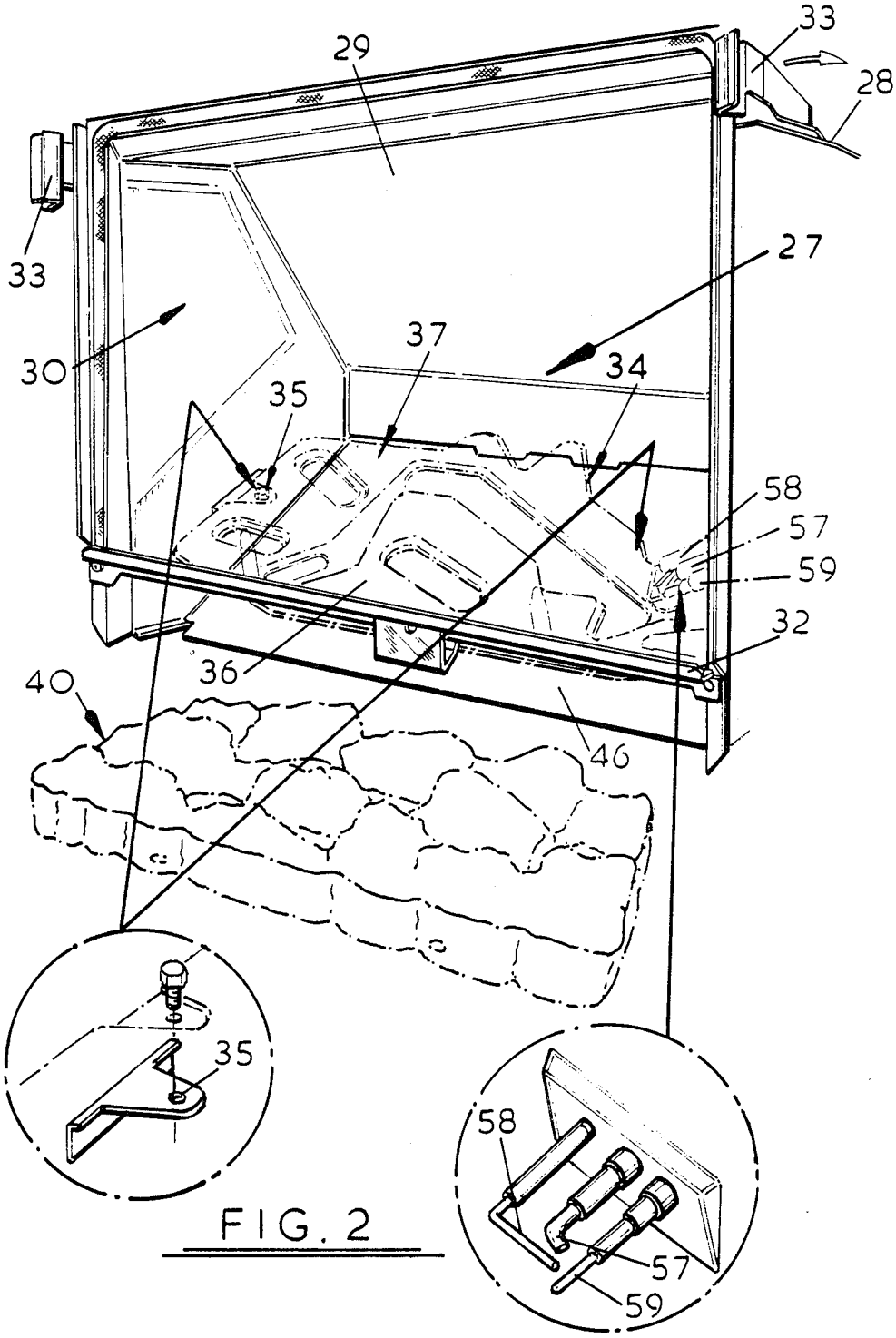
FIG. 2 is an exploded perspective view of the gas fire of FIG. 1 with some details omitted.

The gas fire comprises an outer decorative casing 20 with a top hood or canopy 21 and a fender structure 22 at the front and bottom. These may be of any desired construction provided they present an attractive appearance.

The fender structure 22 has a grille 23 through which air for combustion flows into the combustion chamber of the gas fire. Cool air flows under the bottom of the hood or canopy 21 as indicated at 24 and warm air flows out of the slot apertures 25 at the top of the hood or canopy 21.

The combustion chamber 27 is within an inner casing 28 open at the front and with a back wall 29 and inclined side walls 30 formed of brushed stainless steel for example. This assists the "glow" effect referred to later.

A flue arrangement and heat exchanger (not shown) are connected with the combustion chamber 27. These are of conventional construction and are well known to those skilled in the art. It is for this reason and also because they do not form part of the invention that they are omitted from the drawings.

The front of the inner casing 28 is open and in this instance is closed by a glass window 31 resting on a ledge 32 at the bottom of the open front and held in position at the sides at the top of the open front by pivotal clips 33.

The bottom of the combustion chamber 27 is closed by a gas manifold or box 34 secured to the sides of the inner casing 28 by brackets 35.

Figures 4, 5, 6:
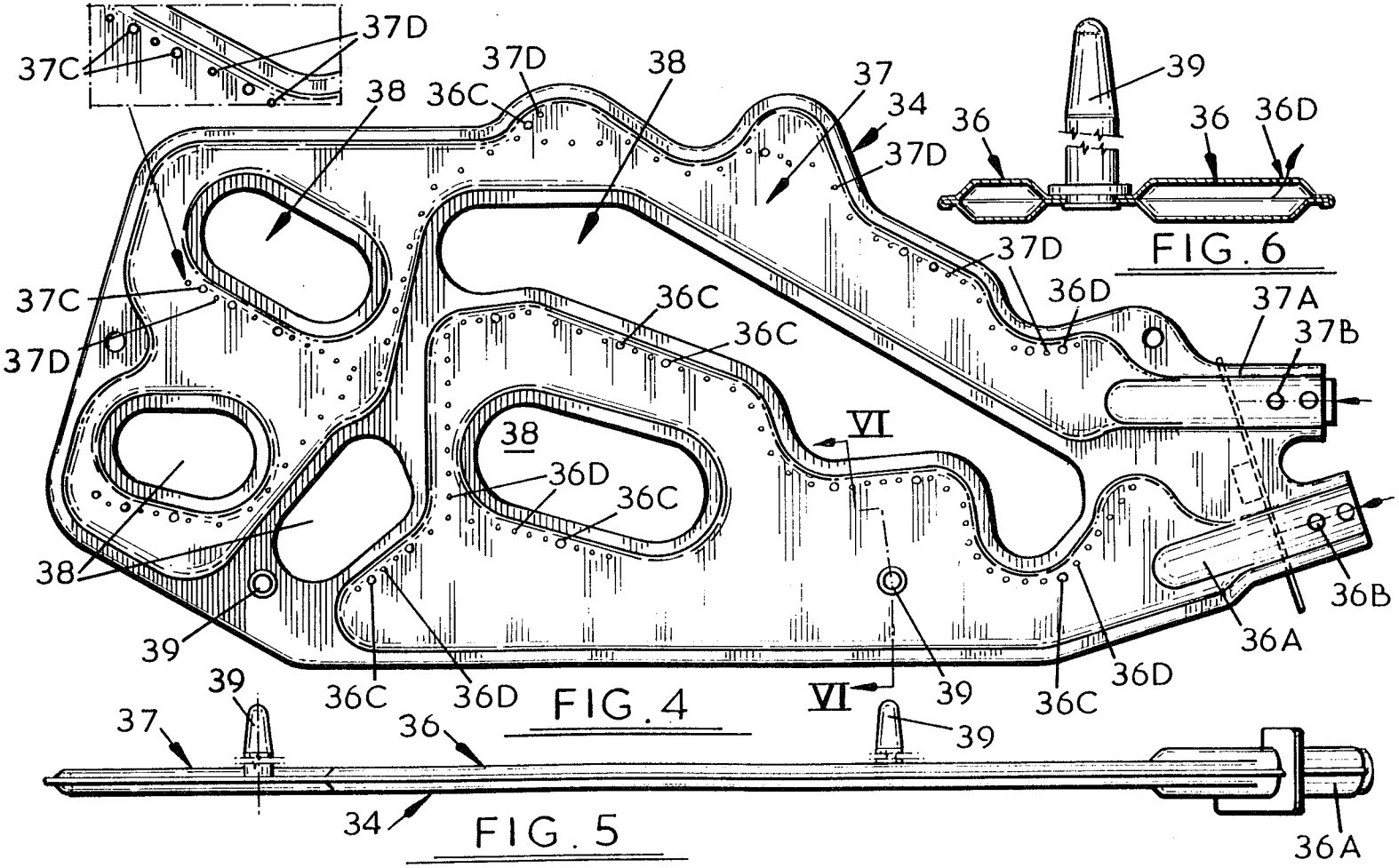
FIG. 4 is a plan view of the gas manifold or box.
FIG. 5 is a side view of the gas manifold or box.
FIG. 6 is a part-sectional view of the gas manifold or box on the line VI—VI of FIG. 4.

The gas manifold or box 34 is relatively thin or flat (see FIGS. 4 to 6), is made of sheet metal, and has two separate gas compartments 36 and 37 lying fore-and-aft relative to the front of the inner casing 28.

The gas manifold or box 34 is formed with a number of illumination apertures 38 which will be referred to later. These apertures 38 are spaced from the gas compartments 36, 37. Inlet passages 36A, 37A are provided respectively for the gas compartments 36, 37 and these have aeration holes or ports 36B, 37B for inflow and mixture of air with the gas. This prevents "sooting".

Around the periphery of each gas compartment 36 or 37 is a series of gas outlets 36C, 36D and 37C, 37D respectively. These gas outlets are also provided partially around the peripheries of the apertures 38. Ignited gas from the larger gas outlets 36C, 37C provide the flames for the gas fire while the ignited gas from the smaller gas outlets 36D, 37D serve to control the size and shape of the flames and serve to cross-light between the flames.

The gas box or manifold 34 has adjacent its front edge two upstanding spigots or dowels 39.

Figure 7:
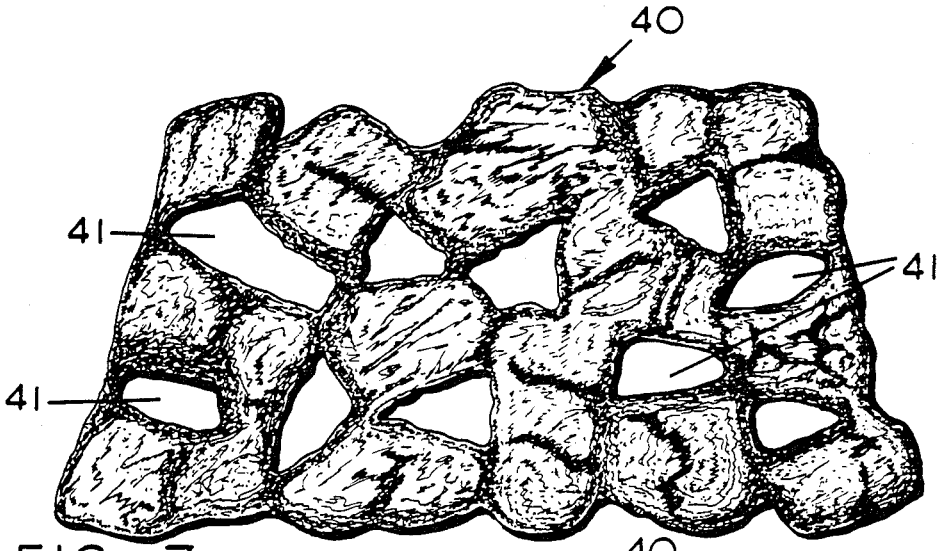
FIGS. 7 to 9 are respectively a plan view, a side view and an underneath plan view of a preferred coal effect.
Figure 8:
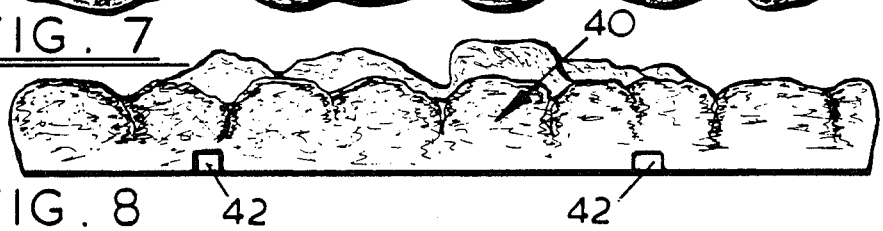
Figure 9:
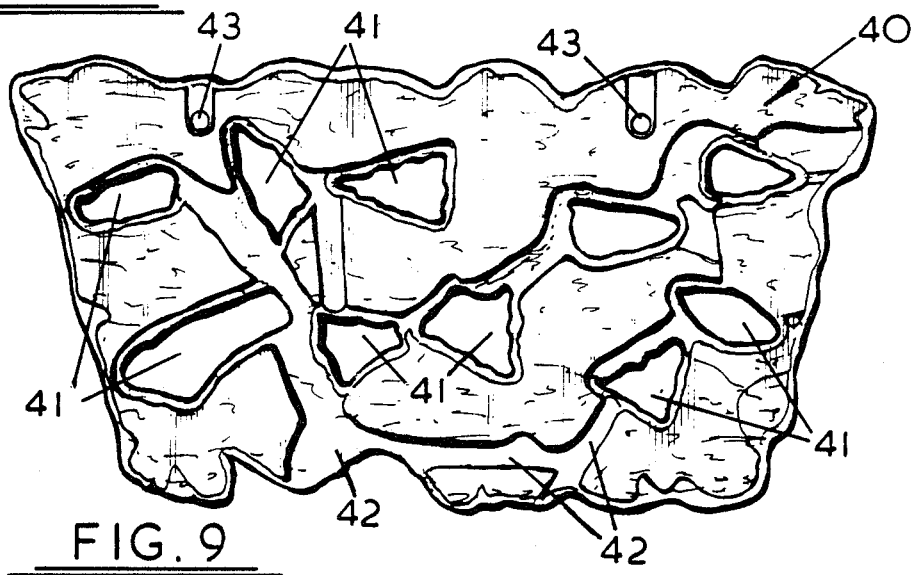

A simulated coal effect 40 (FIGS. 7 to 9) is formed of ceramic material. It is of closed hollow construction with flame/light apertures 41. These flame apertures 41 are linked by cross-lighting channels 42 formed in the bottom of the coal effect 40.

The bottom of the coal effect 40 is also formed with two sockets or recesses 43 for engaging on the spigots or dowels 39 of the gas manifold or box 34. By this means, the flame apertures 41 can be predeterminedly and precisely located adjacent to the gas outlets 36C, 36D and 37C, 37D thereby avoiding "sooting".

A reflector plate 44 forming part of the fender structure 22 of the outer casing 20 mounts an electric lamp holder 45. This plate 44 has a flat bottom 44A and an upwardly and rearwardly inclined portion 44B, and it engages with an upwardly and rearwardly inclined reflector plate 46 in the bottom of the inner casing 28. The reflector plates 44, 46 therefore provide a reflector surface directed both upwardly and forwardly of the gas fire.

A slot 44C is formed in the bottom 44A of the plate 44 to receive a plug 46 for engaging terminals 47 of the lamp holder and which is connectible by a lead 48 to electric mains 49. The lamp holder 45 is wired as indicated at 50 to an on/off switch 51 on the side of the outer casing 20.

Two lamps 52 are connected into the lampholder 45 in parallel so that if one becomes inoperative the other will continue to function.

The lampholder 45 is forwardly of the combustion chamber 27 and is lower than the gas manifold or box 34 and coal effect 40. The reflector plates 44, 46 extend under the latter so that when the lamps 52 are illuminated light is reflected forwardly towards the front of the gas fire and upwardly through apertures 38 and 41 to give the "glow" effect which is enhanced by the brushed stainless steel side walls 30 of the combustion chamber 27.

Figure 10:
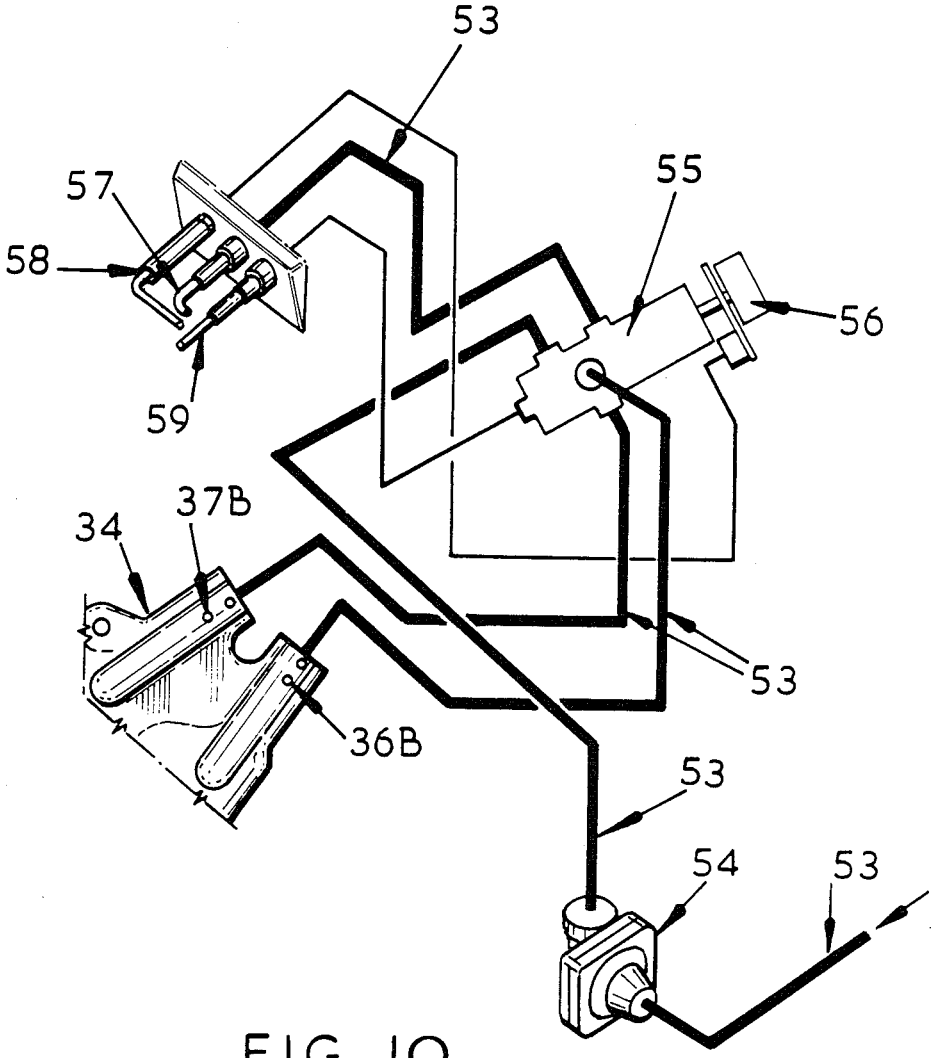
FIG. 10 is a diagrammatic view of the gas supply and controls.

Referring to FIG. 10, gas is supplied to the gas manifold or box 34 from a gas mains by piping 53 which is connected to a gas governor 54 and a main control valve 55 having a setting switch 56 which controls the flow of gas to either or both gas compartments 36, 37 and the rate of such flow. The control valve 55 also delivers gas to a pilot light 57 on the side of the combustion chamber 27 and with which is associated a spark igniter 58 and a "flame failure" thermocouple which will close down the control valve 55 if the pilot light flame fails.

With the gas fire of the present invention all the gas input is used to produce flames and a "glow" effect can be provided with or without the gas fire in operation, i.e. with or without flames. Moreover, with this gas fire the "glow" effect is immediately attainable simply by switching on the on/off switch.

If the gas used is propane gas then a sheet of metallic gauze is disposed between the gas manifold or box 34 and the coal effect 40 to reduce secondary air flow.

A version of this gas fire is visualised which is suitable for use in a conventional solid fuel fireplace. This varies comprises a unit consisting of an electric lamp box, a gas manifold or box and the coal effect. This unit could simply be disposed in a fireplace. A flexible gas pipe with an on/off tap or valve is connected to the gas box and manifold for detachable connection to a gas supply (mains or container) and the electric lead from the lamp holder is simply plugged into the electric mains.

Here again the "glow" effect can be accompanied by flames or not depending on the user's wishes.

What is claimed is:

1. A gas-fired appliance comprising:

(1) a casing open to the front and defining a combustion chamber;

(2) a gas burner of hollow plate-like configuration located within the combustion chamber to divide same into upper and lower compartments, and presenting an upper support surface extending rearwardly from the open front of the combustion chamber;

(3) the gas burner being connectible to a gas supply, being formed with aperture means providing communication between the upper and lower compartments of the combustion chamber, and having gas outlets formed in the upper support surface around and adjacent to the aperture means;

(4) simulated coal effect means supported within the upper compartment of the combustion chamber on the upper support surface of the gas burner;

(5) the simulated coal effect means being formed with aperture means in register with the aperture means in the gas burner to provide communication between the lower compartment of the combustion chamber and a space in the upper compartment of the combustion chamber above the simulated coal effect means;

(6) electric lamp means disposed in the casing downwardly and forwardly of the simulated coal effect means to provide illumination of the casing interior; and (7) reflector means disposed within the lower compartment of the casing under the gas burner to direct light from the electric lamp means through the registering aperture means into the upper compartment of the casing.

2. An appliance as claimed in claim 1 in which said gas burner is a hollow plate-like structure which is relatively shallow in the vertical dimension and which has at one end gas inlet means, said hollow plate-like structure having apertures at a pllurality of locations through which said illumination of the electric lamp means through the intermediary of the reflector means can be viewed from above, and said hollow plate-like structure being sealed around its periphery and around the periphery of each aperture, and said gas outlet means being formed in the upper surface of said hollow plate-like structure around each structure.

3. An appliance as defined in claim 2 in which said gas outlet means is defined by relatively large holes from which flames are emitted when the gas is ignited and relatively small holes at each side of each large hole through which gas is emitted to control the size or shape of the flames.

4. An appliance as claimed in claim 2 in which said gas burner is divided internally to provide a pair of gas compartments, there being a pair of side-by-side gas inlets, one for each gas compartment, and each gas compartment being formed with at least one illumination aperture.

5. An appliance as claimed in claim 4 in which said separate gas compartments are formed by flattening the upper and lower walls of the plate-like structure together at selected areas thereof.

6. An appliance as claimed in claim 1 in which said simulated coal effect means comprises a one-piece closed hollow ceramic body formed with said aperture means extending from top to bottom thereof and of such a size to provide passage for flames, and the ceramic body being coterminous in area with said gas burner hollow plate-like structure to conceal same.

7. An appliance as claimed in claim 6 in which the bottom of said coal effect ceramic body has on its underside cross-lighting channels which join adjacent gas outlets of adjacent apertures.

8. An appliance as claimed in claim 6 further comprising complementary engaging formations formed on the top of said gas burner hollow plate-like structure and the bottom of said coal effect ceramic body to assist correct relative location therebetween to avoid sooting in the appliance.

9. An appliance as claimed in claim 1 in which the electric lamp means is colored to give an instantaneous "glow" effect.

10. An appliance as claimed in claim 1 in which the electric lamp means is controlled separately of the gas supply to the appliance.

* * * * *